US011843200B2

(12) United States Patent
Benichou

(10) Patent No.: US 11,843,200 B2
(45) Date of Patent: Dec. 12, 2023

(54) CONNECTOR WITH A POSITION ASSURANCE ELEMENT HAVING A CONTACT RECEPTACLE

(71) Applicant: TE Connectivity Germany GmbH, Bensheim (DE)

(72) Inventor: Jonathan Benichou, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 27 days.

(21) Appl. No.: 17/411,477

(22) Filed: Aug. 25, 2021

(65) Prior Publication Data

US 2022/0069526 A1 Mar. 3, 2022

(30) Foreign Application Priority Data

Aug. 25, 2020 (DE) ..... 102020210760.2

(51) Int. Cl.
*H01R 13/641* (2006.01)
*H01R 13/422* (2006.01)
*H01R 103/00* (2006.01)

(52) U.S. Cl.
CPC ..... *H01R 13/641* (2013.01); *H01R 13/4223* (2013.01); *H01R 2103/00* (2013.01)

(58) Field of Classification Search
CPC .... H01R 13/53; H01R 13/502; H01R 13/504; H01R 13/506; H01R 13/514; H01R 13/4361; H01R 13/639; H01R 13/4223; H01R 13/424; H01R 13/426; H01R 13/4367; H01R 13/4368; H01R 13/4364; H01R 13/4365; H01R 13/641; H01R 2103/00
USPC ..... 439/353, 355, 354, 595, 686, 489
See application file for complete search history.

(56) References Cited

U.S. PATENT DOCUMENTS 3,829,821 A * 8/1974 Derr ..... H01R 13/633 439/304
4,971,567 A * 11/1990 Mizuno ..... H04M 1/0293 439/441
4,997,386 A * 3/1991 Kawachi ..... H01R 13/6272 439/352
5,928,038 A * 7/1999 Berg ..... H01R 13/6272 439/752
6,261,116 B1 * 7/2001 Ceru ..... H01R 13/6272 439/352

(Continued)

FOREIGN PATENT DOCUMENTS

DE 10 2016 209472 A1 11/2017
EP 0449122 A2 10/1991

(Continued)

OTHER PUBLICATIONS

Extended European Search Report, App. No. 21192711.6-1201, dated Jan. 25, 2022, 12 pages.

(Continued)

*Primary Examiner* — Marcus E Harcum
(74) *Attorney, Agent, or Firm* — Barley Snyder

(57) ABSTRACT

A connector includes a connector position assurance element having a contact receptacle for receiving an electrical contact element, and a connector housing having a contact receptacle for receiving another electrical contact element and a receptacle for receiving the connector position assurance element.

11 Claims, 4 Drawing Sheets

(56) References Cited

U.S. PATENT DOCUMENTS

| | | | | |
|---|---|---|---|---|
| 6,638,108 | B2 * | 10/2003 | Tachi | H01R 13/4223 439/701 |
| 7,011,553 | B2 * | 3/2006 | Hayashi | H01R 13/5812 439/942 |
| 7,588,461 | B2 * | 9/2009 | Tyler | B60L 3/04 439/607.41 |
| 7,641,499 | B1 * | 1/2010 | George | B60L 3/0069 439/352 |
| 8,083,533 | B2 * | 12/2011 | De Chazal | H01R 13/648 200/51.09 |
| 8,747,168 | B2 * | 6/2014 | Kida | H01R 13/506 439/701 |
| 8,998,653 | B2 * | 4/2015 | Kamiya | H01R 13/627 439/701 |
| 9,017,108 | B2 * | 4/2015 | Suemitsu | H01R 13/4223 439/701 |
| 9,039,458 | B2 * | 5/2015 | Tsuchiya | H01R 13/4365 439/701 |
| 10,177,480 | B2 * | 1/2019 | Choi | H01R 13/6275 |
| 11,495,906 | B2 * | 11/2022 | Yamamoto | H01R 13/465 |
| 2002/0173198 | A1 * | 11/2002 | Plate | H01R 13/4362 439/752 |
| 2005/0032404 | A1 * | 2/2005 | Furuta | H01R 13/641 439/157 |
| 2005/0196943 | A1 * | 9/2005 | Ishiwa | H01R 13/641 438/489 |
| 2009/0286418 | A1 | 11/2009 | Takehara | |
| 2013/0095692 | A1 | 4/2013 | Cole | |
| 2015/0171551 | A1 | 6/2015 | Iwatani | |
| 2015/0200484 | A1 * | 7/2015 | Randolph | H01R 13/4368 439/686 |
| 2016/0204539 | A1 * | 7/2016 | Kwon | H01R 13/506 439/701 |
| 2017/0250502 | A1 * | 8/2017 | Endo | H01R 13/641 |
| 2017/0317448 | A1 * | 11/2017 | Benichou | H01R 13/50 |
| 2017/0365424 | A1 * | 12/2017 | Tabata | H01R 13/701 |
| 2018/0358750 | A1 * | 12/2018 | Miyamura | H01R 13/645 |

FOREIGN PATENT DOCUMENTS

| | | | |
|---|---|---|---|
| EP | 3118943 | A1 | 1/2017 |
| EP | 3591769 | A1 | 1/2020 |
| FR | 3010578 | A1 | 6/2013 |

OTHER PUBLICATIONS

Japanese Office Action with English translation, Application No. 2021-133732, dated Aug. 2, 2022, 8 pages.

Indian Examination Report, Application No. 202144038077, dated Mar. 15, 2022, 5 pages.

German Office Action, dated Apr. 9, 2021, 6 pages.

English translation of abstract of DE 10 2016 209472, dated Nov. 30, 2017, 1 page.

Office Action from the Japanese Patent Office dated Feb. 28, 2023 (with English translation thereof), corresponding to Application No. 2021-133732, 11 pages.

Office Action from the Korean Patent Office dated Mar. 24, 2023 (with with English translation thereof), corresponding to Application No. 10-2021-0111133, 15 pages.

* cited by examiner

CONNECTOR WITH A POSITION ASSURANCE ELEMENT HAVING A CONTACT RECEPTACLE

CROSS-REFERENCE TO RELATED APPLICATIONS

This application claims the benefit of German Patent Application No. DE 10 2020 210 760.2 filed on Aug. 25, 2020, the whole disclosure of which is incorporated herein by reference.

FIELD OF THE INVENTION

The present disclosure relates to an electrical connector, and more particularly, to an electrical connector including a connector position assurance element.

BACKGROUND

In the field of electrical connectors, a position assurance element may serve to secure a connection or mating of between a connector and a mating connector. In addition, position assurance elements may be placed into a pre-latched position in which the position assurance element is held in a captive manner on or in the connector housing. In the pre-latched position of the position assurance element, the connector can be connected to a mating connector. The position assurance element can be moved to its end position once the connector is fully mated or connected to the mating connector. The position assurance element then secures the position of the connector relative to the mating connector and prevents the unintentional release of the two. When using connectors with position assurance elements, it is also desirable to obtain confirmation of a completed electrical connection between the connector to the mating connector, and about the position of the position assurance element. However, at the same time, the connector is to be as compact as possible.

Accordingly, it is desirable to provide a connector of the above-mentioned type for which it is easy to verify whether a secure connection to a mating plug has been established, and one that is also compact.

SUMMARY

A connector according to an embodiment of the present disclosure comprises a connector position assurance element having a contact receptacle for receiving an electrical contact element, and a connector housing having a contact receptacle for receiving another electrical contact element and a receptacle for receiving the connector position assurance element.

BRIEF DESCRIPTION OF THE DRAWINGS

The invention will now be described by way of example with reference to the accompanying Figures, of which.

DETAILED DESCRIPTION OF THE EMBODIMENTS

Figure 1:
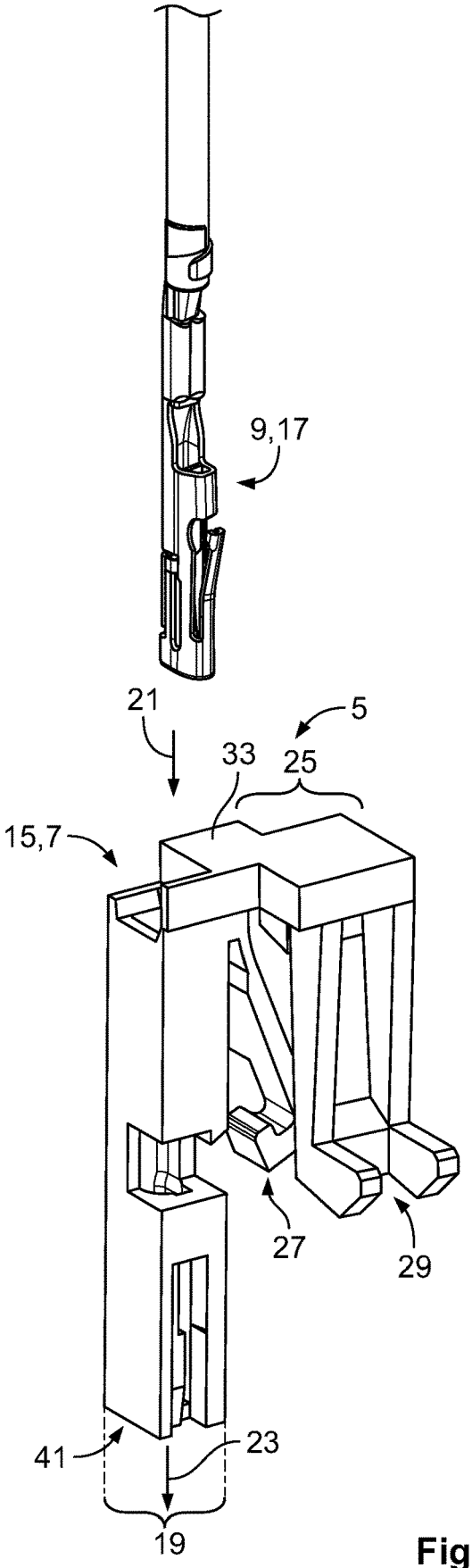
FIG. 1 shows a schematic perspective illustration of a position assurance element with a contact element provided for this position assurance element.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The structure and the function of a connector 1 according to the present disclosure having a connector housing 3 and a position assurance element 5 is described herein with reference to FIGS. 1-6. The form of the connector 1 shown is only exemplary, and different forms of a connector which include a connector housing and a position assurance element are also possible.

Figure 2:
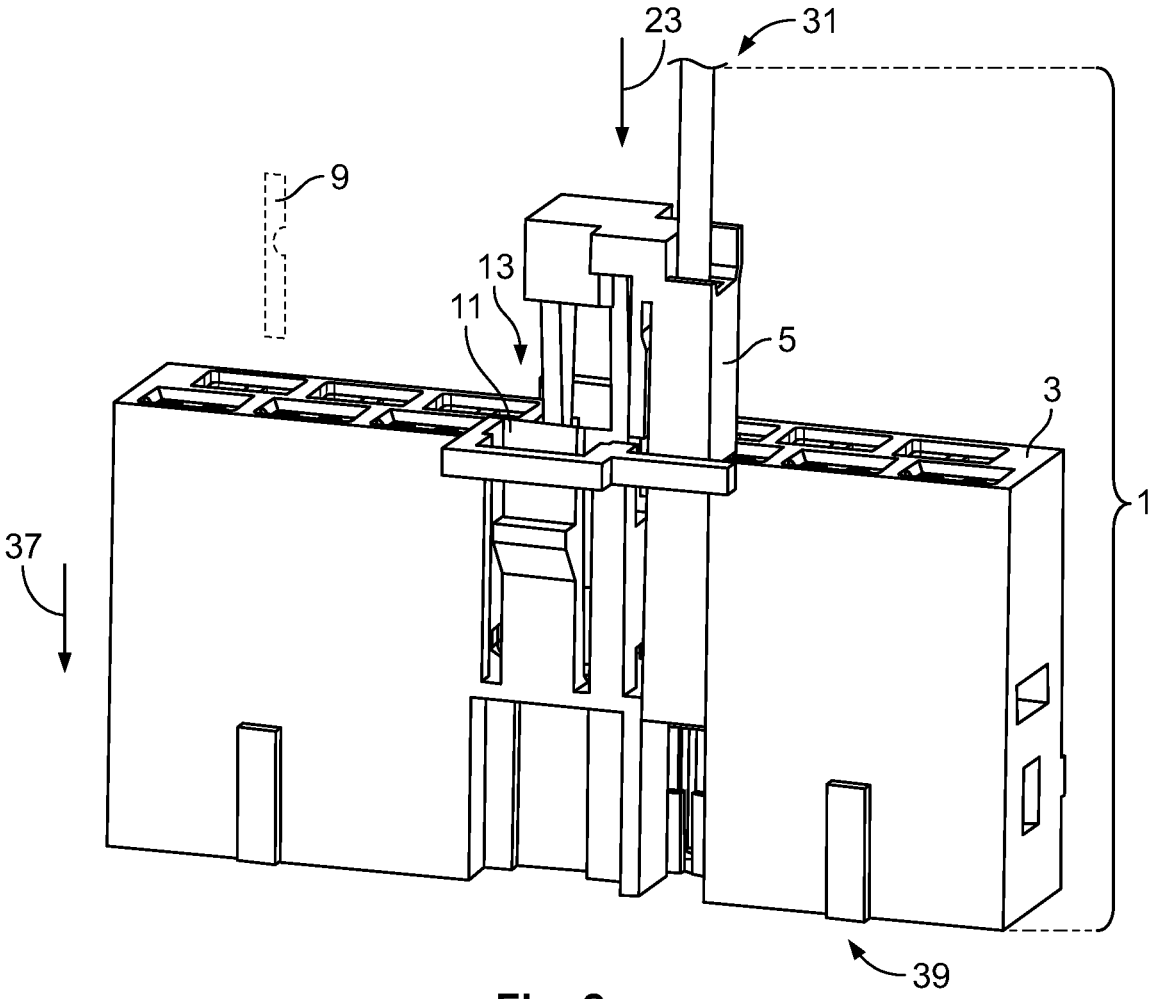
FIGS. 2 and 3 show the position assurance element from FIG. 1 in a pre-latched position in a connector housing.

The connector housing 3 includes several contact receptacles 7 for receiving corresponding contact elements 9 (indicated by broken lines in FIG. 2). The connector housing 3 can be plugged or mated together with a mating connector for connecting the contact elements 9 to corresponding mating contact elements in an electrically conductive manner.

The connector housing 3 includes a latching tab 11 for latching the connector housing to the mating connector. In order to prevent unintentional release of the latching tab 11, a receptacle 13 for the position assurance element 5 is provided adjoining the latching tab. In a state when inserted into the receptacle 13, the position assurance element 5 prevents a deflection of latching the tab 11 such that the connector housing 3 cannot be removed from the housing of the mating connector before the position assurance element 5 has been removed. In this way, the position assurance element 5 may be described as a connector position assurance device, or "CPA".

The position assurance element 5 according to the present disclosure includes at least one contact receptacle 15 for receiving an electrical contact element 17. The position assurance element 5 shown is provided with one contact receptacle 15 merely by way of example. Alternatively, more than one contact receptacle 15 can also be present. The contact receptacle 15 is preferably substantially identical to one of contact receptacles 7. In other words, the contact elements 9 are preferably of the same design as the contact elements 17 such that contact elements of the same design can be used both for the position assurance element 5 as well as for the remainder of the connector housing 3.

The position assurance element 5 is provided with a housing section 19 at least in part surrounding the contact receptacle 15 for receiving the at least one contact element 17. The housing section 19 is configured such that the electrical contact element 17 can be securely held therein. The housing section 19 preferably extends parallel to a direction of insertion 21 along which the contact element 17 can be inserted into the contact receptacle 15. The direction of insertion 21 for the contact element 17 preferably, but not necessarily, runs parallel to a direction of insertion 23 along which the position assurance element 5 can be inserted into the receptacle 13. In the embodiment shown, the directions 21 and 23 are parallel to one another.

Figure 3:
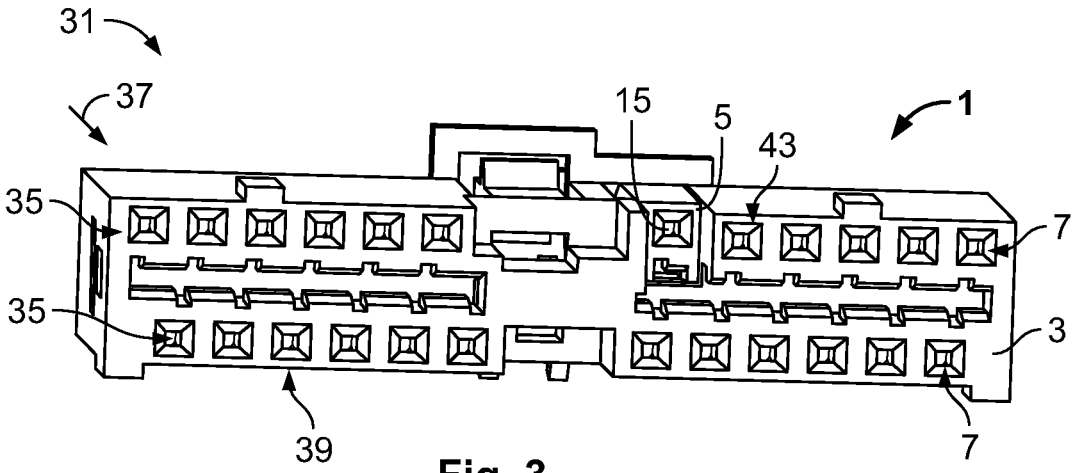

The position assurance element 5 includes a position assurance section 25 transverse to the direction of insertion 23 and spaced apart from the housing section 19. The position assurance section 25 includes latching devices 27 and 29 which assume the functions of the position assurance element 5. This includes both the temporary latching in a pre-latched position 31, as shown in FIGS. 2 and 3, and latching in an end position when connector 1 is plugged together with a mating connector. The two sections 19 and 25 are preferably connected to one another by way of a material bridge 33. The material bridge 33 is preferably seated on an end of the position assurance element 5 that is disposed opposite to the direction of insertion 23 in order not to obstruct the insertion of the position assurance element 5 into the receptacle 13.

In the embodiment shown, the connector housing 3 includes two rows 35 of contact receptacles 7. The rows 35 extend parallel to one another and transverse to a plug-in direction 37 along which the connector 1 can be connected to a mating connector. In the embodiment shown, the direction of insertion 37 is parallel to the direction of insertion 23 and also parallel to the direction of insertion 21. However, this is not required. The contact receptacles 7 are accessible on one side of the connector housing 3 from the outside for connecting to mating contact elements of a mating connector so that a connector face 39 is formed on this side. The connector face 39 is shown in FIG. 3.

In a state in which the position assurance element 5 is inserted completely into the receptacle 13, i.e. in the end position of the position assurance element 5 (shown as end position 55 in FIG. 6), position assurance element complements the connector face 39, at least with its housing section 19. The contact receptacle 15 of the position assurance element 5 is then disposed within one of rows 35. In FIG. 3, this is upper row 35. The contact receptacle 15 of the position assurance element 5 preferably aligns flush along the direction of insertion 23 with the contact receptacles 7 of the connector housing 3.

In a state 55 in which the position assurance element 5 is inserted completely into the connector housing 3, an end 41 of the contact receptacle 15 on the connector face side aligns flush with an end 43 of at least one of the contact receptacles 7 of the connector housing on the connector face side.

Figure 4:
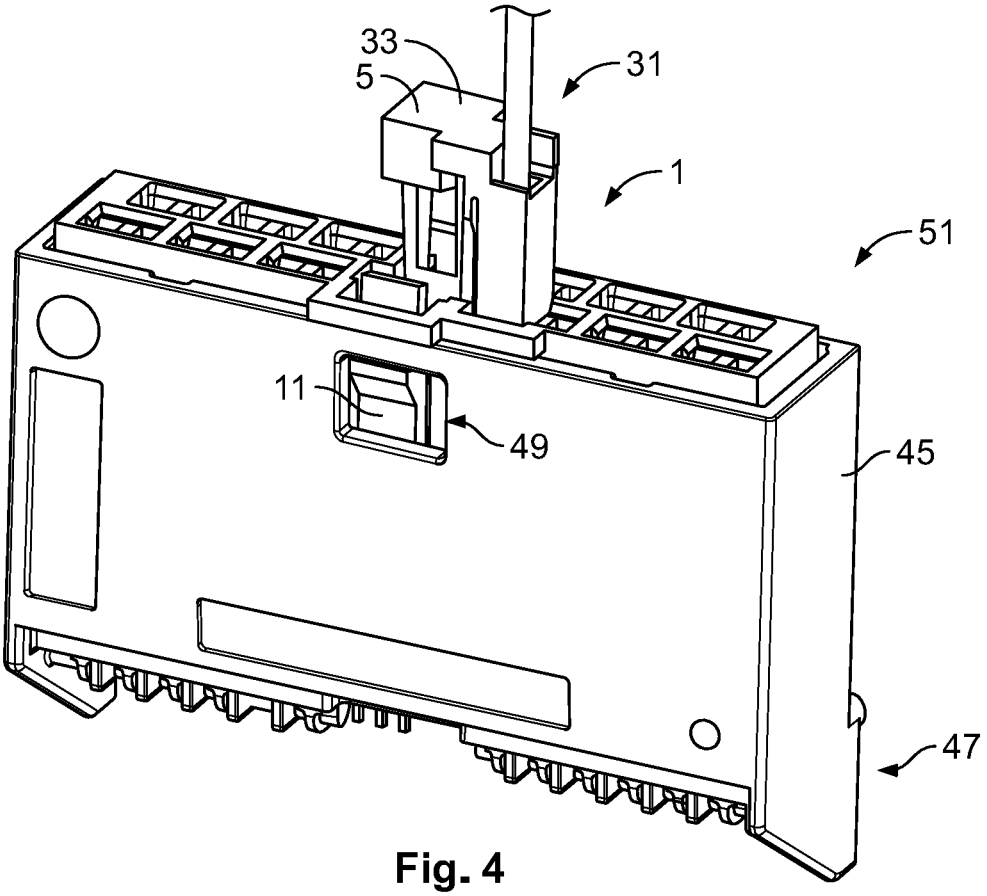
FIGS. 4 and 5 show the connector housing with the position assurance element from FIGS. 2 and 3 inserted into a housing of a mating connector.
Figure 5:
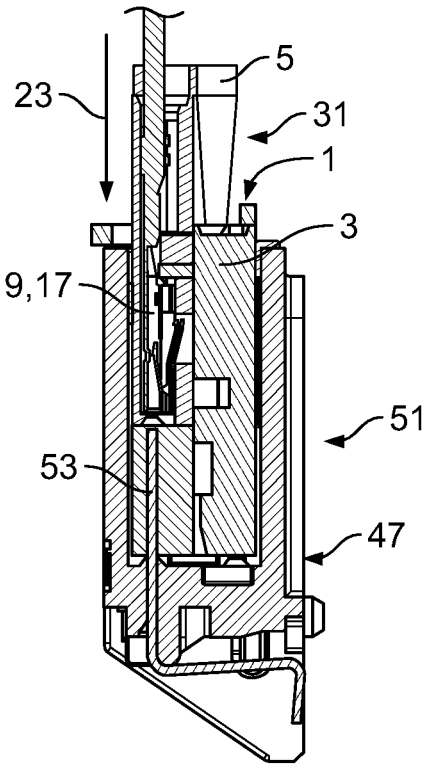

The connector 1 of FIGS. 2 and 3 is shown in FIGS. 4 and 5, where the position assurance element 5 is still disposed in the pre-latched position 31. The connector 1 is shown inserted completely into a housing 45 of a mating connector 47. The latching tab 11 is arranged in a latching receptacle 49 of the housing 45. The connector 1 and the mating connector 47 together form a connector assembly 51.

In pre-latched position 31, the contact element 17 received in the contact receptacle 15 of the position assurance element 5 is not yet electrically connected to a mating contact element 53 of the mating connector 47. Instead, the contact element 17 is spaced in an electrically insulating manner from the mating contact element 53. The contact elements 9 which are arranged in the contact receptacles 7 of the connector housing 3, however, may already be connected in an electrically conductively manner to their corresponding mating contact elements 53. It can be electrically detected (e.g., via a continuity circuit connected therebetween, or a resistance detector) that no electrically conductive connection has yet been established between the contact element 17 and the mating contact element 53. As a result, it is known that the position assurance element 5 is not yet inserted completely into its receptacle 13, and therefore the connector 1 is not yet completely and securely connected to the mating connector 47.

Figure 6:
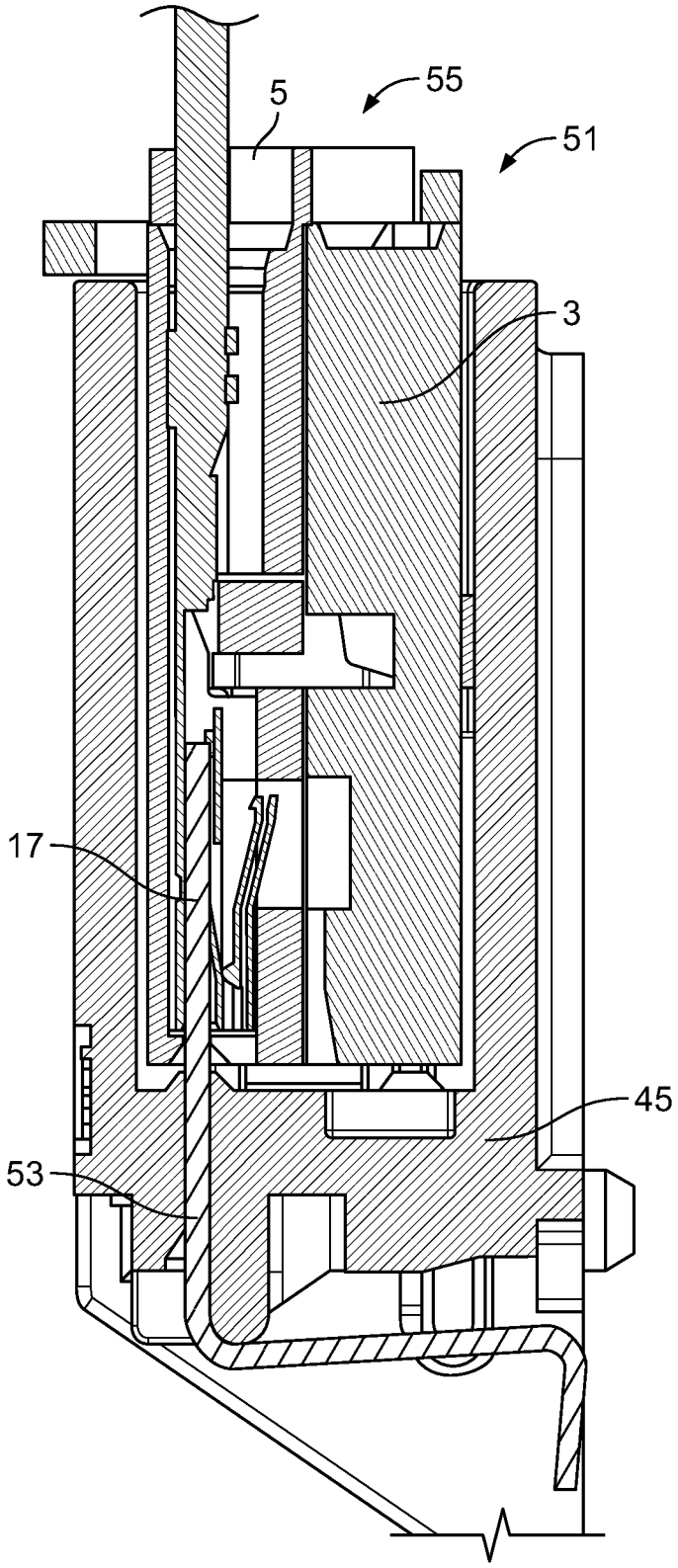
FIG. 6 shows a cross section through a connector assembly with the connector inserted completely into the mating connector and the position assurance element in its end position.

To completely secure the connector 1 to the mating connector 47, the position assurance element 5 is moved further along the direction of insertion 23 into the receptacle 13. This can be done, for example, by pressing the bridge 33 manually or in an automated manner. When the position assurance element 5 has been inserted completely into the receptacle 13, the position assurance element is in its end position 55, as shown in FIG. 6. In the end position 55 of the position assurance element 5, the latching tab 11 is secured against any motion out of the latching receptacle 49. As a result, the connector 1 and the mating connector 47 are secured against unintentional release.

At the same time, the contact element 17 and the mating contact element 53 are electrically contacted or connected in the end position 55. As a result, all of the contact elements 9 and 17 of the connector 1 are connected in an electrically conductive manner to their corresponding mating contact elements 53 of the mating connector 47. By establishing electrical contact between the contact element 17 of the position assurance element 5 and the mating contact element 53, it can be detected that the position assurance element has reached its end position 55. This provides the information about the completed connection of the connector 1 to the mating connector 47.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

a connector position assurance element, including:

a housing section at least in part surrounding a contact receptacle for receiving an electrical contact element; and a position assurance section with at least one latching device, the housing section and the position assurance section spaced apart from one another in a first lateral direction transverse to a plug-in direction of the connector; and a connector housing including a plurality of contact receptacles arranged in a row extending in the first lateral direction for receiving respective other electrical contact elements, and a receptacle for receiving the connector position assurance element, the latching device latching the connector position assurance element in the connector housing, wherein the connector housing further includes a latching tab for fixing the connector housing to a mating connector, with the connector position assurance element inserted into the connector housing the position assurance section of the connector position assurance element is aligned with the latching tab in the plug-in direction of the connector and the housing section is arranged adjacent the latching tab in the first lateral direction.

2. The connector according to claim 1, wherein the contact receptacle of the connector position assurance element and the contact receptacle of the connector housing are adapted to receive electrical contact elements of the same type.

3. The connector according to claim 2, wherein, when inserted into the connector housing, the contact receptacle of the position assurance element is arranged in the row.

4. The connector according to claim 3, wherein the connector housing and the connector position assurance element form a common connector face with the position assurance element inserted into the connector housing.

5. The connector according to claim 4, wherein, with the connector position assurance element inserted into the connector housing, one end of the contact receptacle of the connector position assurance element on a connector face side aligns flush with one end of at least one contact receptacle of the connector housing on the connector face side.

6. The connector according to claim 5, further comprising a first electrical contact element in the contact receptacle of the connector position assurance element and a second electrical contact element in the contact receptacle of the connector housing.

7. The connector according to claim 6, wherein the first and second electrical contact are of the same design.

8. The connector according to claim 6, wherein in a pre-latched position of the connector position assurance element, the contact element inserted into the connector position assurance element is spaced apart from the connector face.

9. The connector according to claim 8, wherein in the pre-latched position of the connector position assurance element, the contact element inserted into the connector position assurance element is spaced in an electrically insulating manner from a mating contact element in a mating connector that is connectable to the connector.

10. The connector according to claim 1, wherein the receptacle receiving the connector position assurance element includes a slot receiving the housing section in the plug-in direction of the connector, the slot open in a direction transverse to the plug-in direction of the connector and the first lateral direction.

11. The connector according to claim 10, wherein the housing section includes a continuous first outer sidewall, the first sidewall aligning flush with an outer sidewall of the connector housing with the housing section of the connector position assurance element inserted into the slot.

* * * * *